US006527256B2

(12) United States Patent
Doyle, Jr.

(10) Patent No.: US 6,527,256 B2
(45) Date of Patent: Mar. 4, 2003

(54) FENCE CORNER AND STRETCH POST ASSEMBLY

(76) Inventor: Thomas L. Doyle, Jr., 140 FM 1753, Denison, TX (US) 75021

( * ) Notice: Subject to any disclaimer, the term of this patent is extended or adjusted under 35 U.S.C. 154(b) by 0 days.

(21) Appl. No.: 09/932,635

(22) Filed: Aug. 20, 2001

(65) Prior Publication Data

US 2002/0027223 A1 Mar. 7, 2002

Related U.S. Application Data

(60) Provisional application No. 60/229,742, filed on Sep. 5, 2000.

(51) Int. Cl.[7] ..... E04H 17/14
(52) U.S. Cl. ..... 256/65; 256/35; 256/59
(58) Field of Search ..... 256/65, 35, 36, 256/64, 59

(56) References Cited

U.S. PATENT DOCUMENTS

| | | | | |
|---|---|---|---|---|
| 814,403 A | * | 3/1906 | Smith | 256/35 |
| 2,445,545 A | * | 7/1948 | Verner | 256/35 |
| 2,906,551 A | * | 9/1959 | May | 256/59 X |
| 3,349,538 A | * | 10/1967 | Crossman | 256/59 X |
| 3,833,201 A | * | 9/1974 | Dill | 256/35 |
| 4,101,226 A | | 7/1978 | Parisien | |
| 4,616,950 A | * | 10/1986 | Morris | 256/65 X |
| 4,893,787 A | | 1/1990 | Watson | |
| 5,139,235 A | | 8/1992 | Kilmer | |
| 5,277,408 A | | 1/1994 | Parker | |
| 5,496,016 A | | 3/1996 | Parisien | |
| 5,577,713 A | * | 11/1996 | Navarez | 256/64 |
| 5,738,342 A | | 4/1998 | Van Winkle | |
| 5,967,498 A | * | 10/1999 | Junell | 256/59 X |

FOREIGN PATENT DOCUMENTS

| | | | | |
|---|---|---|---|---|
| JP | 6316996 | * | 11/1994 | 256/59 |

* cited by examiner

*Primary Examiner*—Lynne H. Browne
*Assistant Examiner*—David E. Bochna
(74) *Attorney, Agent, or Firm*—Randal D. Homburg

(57) ABSTRACT

The invention is a component assembly for fabricating corner and stretch fence posts for fencing, including vertical posts and bolt-on horizontal components having end channel pieces to secure the horizontal components to the vertical posts using threaded studs and lock nuts.

2 Claims, 2 Drawing Sheets

FENCE CORNER AND STRETCH POST ASSEMBLY

CROSS REFERENCE TO RELATED APPLICATIONS

Provisional Patent Application Ser. No. 60/229,742 filed on Sep. 5, 2000.

BACKGROUND OF INVENTION

1. Field of the Invention

The invention is a component assembly for fabricating corner and stretch fence posts for fencing, including vertical posts, and bolt-on horizontal components having end channel pieces to secure the horizontal components to the vertical posts using threaded studs and lock nuts.

2. Description of Prior Art

The following United States patents are identified, disclosed and incorporated herein. Several devices are disclosed relating to fencing assemblies. In U.S. Pat. Nos. 5,496,016 and 4,101,226 to Parisien, a bolt together fencing system is disclosed having a formed bracket engaging right angle sets of slots is disclosed, the nuts and bolts forcing the brackets tightly within the channels. A welded leg attaching a corner post is disclosed in U.S. Pat. No. 4,893,787 to Watson. A corner post assembly featuring auger post bracing is disclosed in U.S. Pat. No. 5,139,235 to Kilmer. Flat-sided galvanized steel posts and channel parts for flat fencing panel is disclosed in U.S. Pat. No. 5,277,408 to Parker which employs multiple nuts and bolts and brackets for attaching the multiple components. The Van Winkle patent, U.S. Pat. No. 5,738,342, discloses interlocking posts and braces for forming corner posts.

SUMMARY OF THE INVENTION

The primary objective of the current invention is to provide a fence post assembly for corner or stretch posts which is provided in a longitudinal and easily transferable bundle having vertical posts with pre-welded threaded studs and horizontal members having pre-welded channel plates on each end of the horizontal members attaching to the threaded studs of the vertical components for quick and secure assembly of the vertical posts and horizontal members into corner or stretch posts by a single user with minimal tools or technical skill.

DESCRIPTION OF THE DRAWINGS

The following drawings are informal drawings submitted with this provisional patent application.

DESCRIPTION OF THE PREFERRED EMBODIMENT

Figure 1:
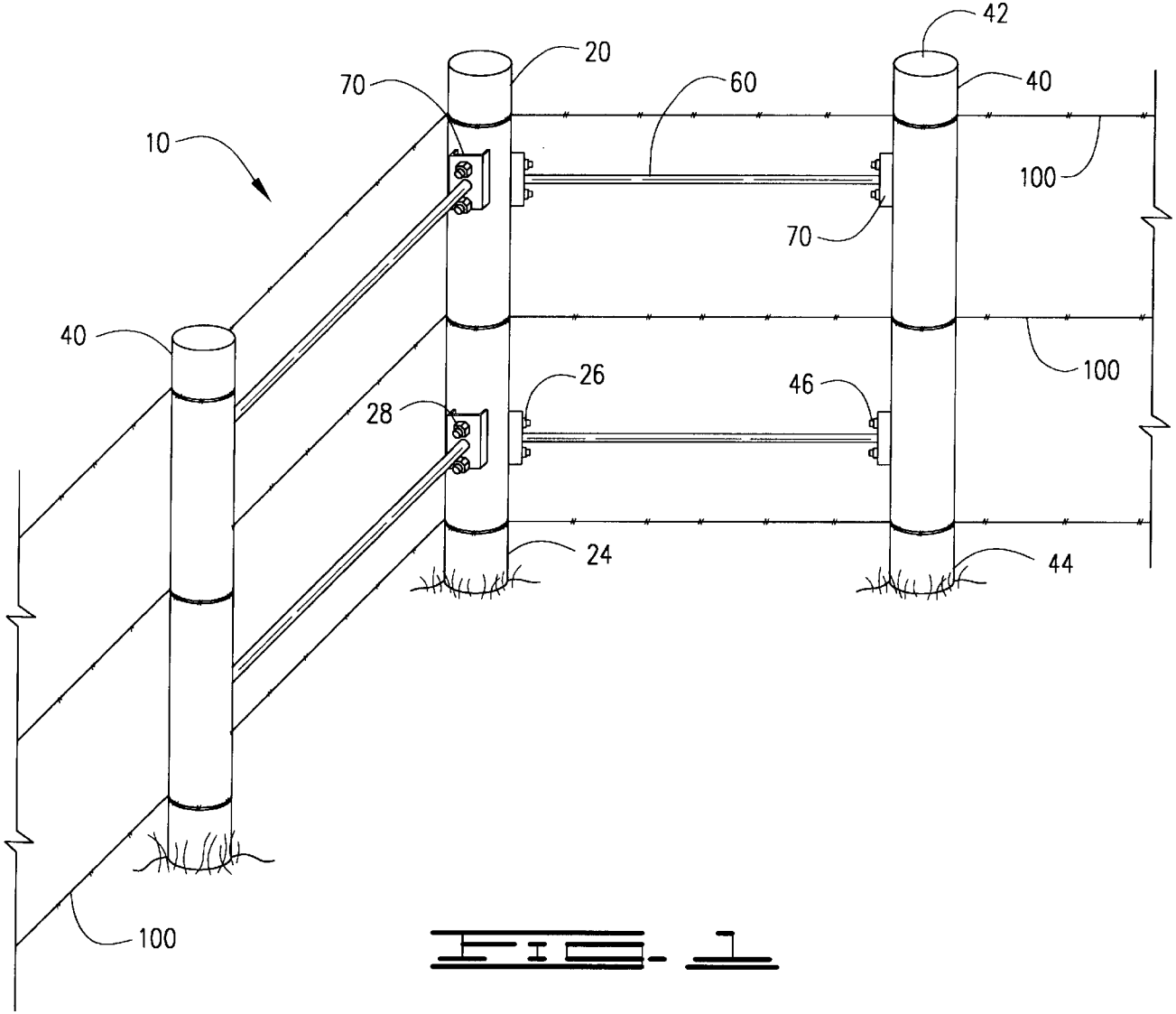
FIG. 1 is a perspective drawing of the invention.
Figure 2:
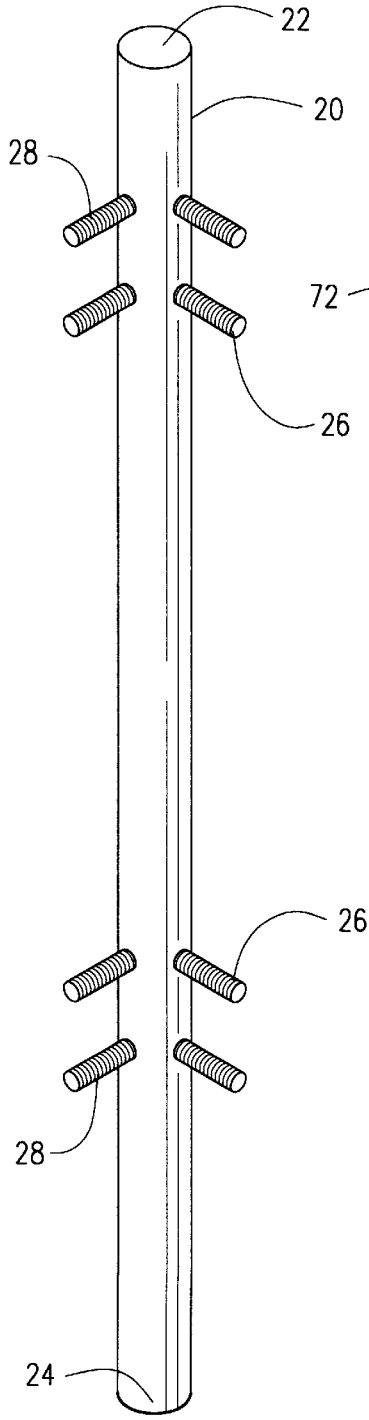
FIG. 2 is a side view of the vertical posts.
Figure 3:
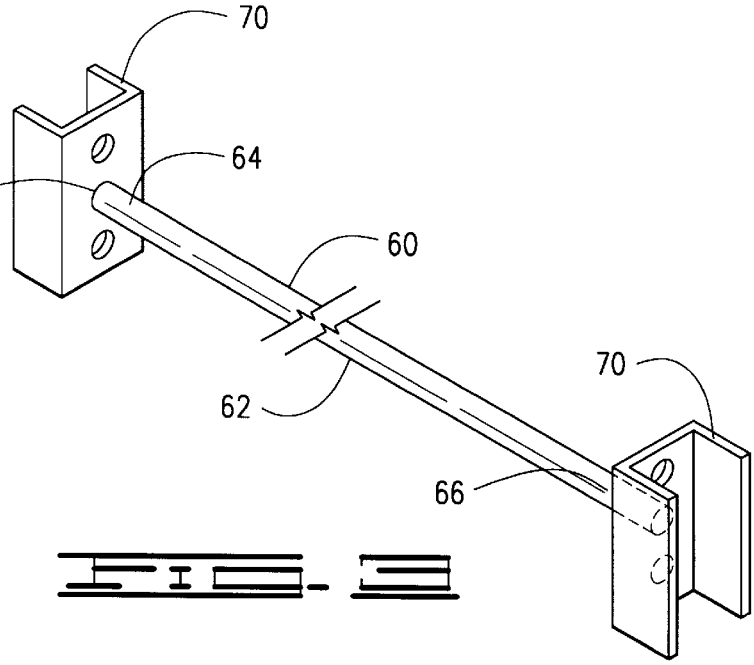
FIG. 3 is a side view of the horizontal members.
Figure 4:
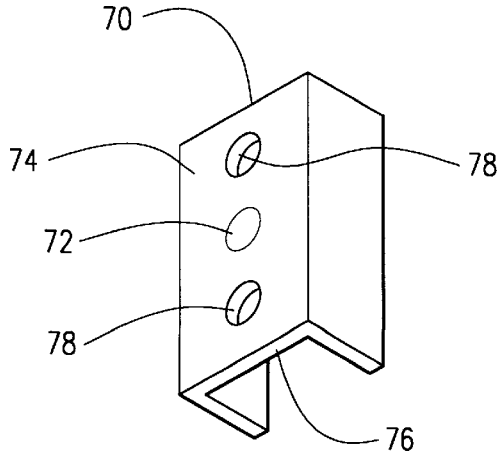
FIG. 4 is a perspective view of the channel brace.

The invention 10 is a component assembly device for the erection of a fence corner post and stretch post comprising a first vertical post 20, one or more second vertical posts 40, and two or more horizontal members 60 having channel segments 70, the horizontal members 60 attaching to the first vertical post 20 and second vertical posts 40 by lock nuts 80.

The first vertical post 20 is a rigid cylindrical pipe having an upper end 22 and a lower end 24. Between the lower end 24 and the upper end 22, at least two first sets of a pair of threaded studs 26 in vertical alignment are affixed to the first vertical post 20. At least two second sets of a pair of threaded studs 28 in vertical alignment are also affixed to the first vertical post 20 ninety degrees around the first vertical post 20 from the first sets of pairs of threaded studs 26.

The second vertical post 40 is a rigid cylindrical pipe having an upper end 42 and a lower end 44. Between the lower end 44 and the upper end 42, at least two sets of a pair of threaded studs 46 in vertical alignment are affixed to the second vertical post 40. For function as a corner post, a combination of one first vertical post 20 and two second vertical posts 40 are utilized, and for a stretch post, two second vertical posts 40 are utilized.

The horizontal members 60 includes a rigid cylindrical pipe 62 having a first end 64 and a second end 66. To each first end 64 and second end 66 of the rigid cylindrical pipe 62, a channel segment 70 is attached at a point of attachment 72, such channel segment 70 having a front smooth surface 74 and a rear channel surface 76, the point of attachment 72 being found on the smooth front surface 74. A pair of vertically aligned holes 78 traverse from the front smooth surface 74 to the rear channel surface 76. This pair of vertically aligned holes 78 are spaced apart an equal distance as every pair of threaded studs 26, 28, 46 on the first vertical post 20 and second vertical posts 40. It is preferred that the placement of the pairs of vertically aligned holes 78 in the channel segment 70 are oriented to place one hole above the point of attachment 72 and one hole below the point of attachment 72.

In a corner post embodiment, the horizontal members 60 are attached to the first vertical post 20 by engaging the pair of vertically aligned holes 78 with the two first sets of the pair of vertically aligned threaded studs 26, attaching the rear channel surface 76 of the channel segment 70 on the first end 64 of the horizontal member 60 to the first vertical post 20 using lock nuts 80 engaging each threaded stud 26. One second vertical post 40 is then attached to the second end 66 of the horizontal members 60 already attached to the first vertical post 20, aligning the two pair of vertical threaded studs 46 on the second vertical post 40 with the vertically aligned holes 78 in the channel segment 70 on the second end 66 of the horizontal member 60, tightening the rear channel surface 76 of the channel segment 70 against the second vertical post 40 using more lock nuts 80. More horizontal members 60 are then attached to the two second sets of the pair of threaded studs 28 located ninety degrees around the first vertical post 20 in the same manner as the previous attachment of the horizontal members 60, and an additional second vertical post 40 is attached to the additional horizontal members 60 with the corner post assembly forming a right angle. The lower end 24 of the first vertical post 20 and the lower ends 44 of the second vertical posts 40 are then securely anchored to the ground. Once securely anchored, fencing wire 100 may be stretched from the invention 10.

In a stretch post embodiment, two horizontal members 60 are attached between two second vertical posts 40, again attaching the rear channel surface 76 of the channel segment 70 of the horizontal members 60 against each second vertical post 40 using lock nuts 80. The lower end 44 of each second vertical post 40 is then securely anchored in the ground. When using this invention 10 in the stretch post embodiment, proper wire stretching procedure is recommended so that when the fencing wire 100 is stretched on the stretch post embodiment, the lower end 44 of each second vertical post 40 is not lifted from the ground, tipping the corner post embodiment towards the direction the wire is being stretched.

Although the embodiments of the invention have been described and shown above, it will be appreciated by those skilled in the art that numerous modifications may be made therein without departing from the scope of the invention as herein described.

I claim:

1. A component assembly device for the erection of a fence corner post comprising:

a. a first vertical post, having an upper end and a lower end between which are attached at least two first sets of a pair of threaded studs in a vertical alignment, with two second sets of a pair of threaded studs ninety degrees around the first vertical post from the two first sets of a pair of threaded studs, also between the upper end and lower end;

b. two second vertical posts, having an upper end and a lower end between which are attached at least two third sets of a pair of threaded studs in a vertical alignment; and c. at least four horizontal members, each horizontal member having a first end and a second end, to which is attached a channel segments, the channel segment having a front smooth surface with a point of attachment to each first end and second end of the horizontal member, a rear channel surface, and a pair of vertically aligned holes spaced apart an equal distance, oriented to accept each first sets, second sets and third sets of pairs of threaded studs, whereupon the channel segments of the horizontal members are attached to the first and second vertical posts by placing the vertically aligned holes upon each set of pairs of threaded studs and applying a lock nut to each threaded stud, after which the device, assembled by connecting each second vertical post to the first vertical post by at least two of the horizontal members forming a right angle assembly, may be used for a fencing corner post once securely installed in the ground.

2. A component assembly device for the erection of a fence stretch post comprising:

a. two vertical posts having an upper end and a lower end between which are attached at least two sets of a pair of threaded studs in a vertical alignment;

b. two horizontal members, each horizontal member having a first end and a second end, to which is attached a channel segments, the channel segment having a front smooth surface with a point of attachment to each first end and second end of the horizontal member, a rear channel surface, and a pair of vertically aligned holes spaced apart an equal distance, oriented to accept each of the sets of pairs of threaded studs, whereupon the channel segments of the horizontal members are attached to the second vertical posts by placing the vertically aligned holes upon each set of pairs of threaded studs and applying a lock nut to each threaded stud, after which the device, assembled by connecting one second vertical post to the other vertical post by at least two of the horizontal members forming a linear assembly, may be used for a fencing stretch post once securely installed in the ground.

* * * * *